US005197071A

United States Patent [19]

Yamada

[11] Patent Number: 5,197,071

[45] Date of Patent: Mar. 23, 1993

[54] PHOTON STORAGE RING

[75] Inventor: Hironari Yamada, Tokyo, Japan

[73] Assignee: Sumitomo Heavy Industries, Ltd., Tokyo, Japan

[21] Appl. No.: 555,473

[22] PCT Filed: Mar. 14, 1989

[86] PCT No.: PCT/JP89/00271

§ 371 Date: Aug. 8, 1990

§ 102(e) Date: Aug. 8, 1990

[87] PCT Pub. No.: WO90/07856

PCT Pub. Date: Jul. 12, 1990

[30] Foreign Application Priority Data

Dec. 23, 1988 [JP] Japan ..... 63-323716
Mar. 13, 1989 [JP] Japan ..... 1-60479

[51] Int. Cl.[5] ..... H01S 3/00

[52] U.S. Cl. ..... 372/2; 372/94; 372/98; 372/99; 372/102; 372/108

[58] Field of Search ..... 372/2, 98, 99, 102, 372/108, 94; 328/235, 239, 233; 331/81, 82

[56] References Cited

U.S. PATENT DOCUMENTS 3,879,679 4/1975 Mourier ..... 372/2
4,323,857 4/1982 Brau et al. ..... 372/2
4,442,522 4/1984 Brau et al. ..... 372/2
4,466,101 8/1984 Schoen ..... 372/2
4,529,942 7/1985 Pitel et al. ..... 372/2 X
4,598,415 7/1986 Luccio et al. ..... 378/119
4,661,783 4/1987 Gover et al. ..... 331/82
4,740,973 4/1988 Maday et al. ..... 372/2

FOREIGN PATENT DOCUMENTS 105032 4/1984 European Pat. Off. .
61-234085 10/1986 Japan .
2065363 6/1981 United Kingdom .

OTHER PUBLICATIONS

Patent Abstracts of Japan, vol. 12, No. 90 (P-679) (2937) Mar. 24, 1988.
Patent Abstracts of Japan, vol. 13, No. 288 (E-781) (3636), Jun. 30, 1989.

*Primary Examiner*—Georgia Y. Epps
*Attorney, Agent, or Firm*—Burns, Doane, Swecker & Mathis

[57] ABSTRACT

In a photon storage ring for storing SR light to generate the same through an outlet port, a reflection mirror is disposed to surround a circular orbit along which bundles of charged particles revolve at a speed close to the velocity of light, generating SR light at a direction tangential to the circular orbit. The reflection mirror has curvature such that the SR light generated in the tangential direction is reflected on the reflection mirror and sent as reflection SR light which is tangential to the orbit. The SR light and the reflection SR light interfere with each other and are guided towards the outlet port.

13 Claims, 6 Drawing Sheets

PHOTON STORAGE RING

FIELD OF THE ART

The present invention relates to an SR light source for generating synchrotron radiation light (hereinafter abbreviated as SR light) by making charged particles, such as electrons, revolve along a predetermined particle orbit.

TECHNICAL BACKGROUND

Generally, in a type of a SR light source, wherein charged particles are moved along a circular orbit or an orbit having a straight portion at a speed close to the light velocity with the aid of a single magnet or a plurality of magnets, SR light is generated in the tangential direction of the orbit. SR light beam lines for taking out SR light are normally disposed at a plurality of locations along the orbit. Since the wavelengths of this SR light include short wavelength component, it is expected that the SR light can be utilized in various uses, such as micro-fine machining of super LSI's or the like.

However, in the SR light source in the prior art, practically available SR light was only a small part of a generated light beam, and in practice, the remainder was wasted in a light beam dump, and consequently, the SR light source in the prior art had a shortcoming that a utilization efficiency of light was low.

In addition, since SR light generated from an SR light source has its wavelength components distributed over a wide range and it is incoherent light, it is a common practice that when the SR light is practically used, a wafer for super LSI's or the like is irradiated thereby through a filter or the like. Accordingly, if the SR light also having the nature of monochromatic SR light source, it is expected that the use of SR light and an SR light source would be greatly expanded. Furthermore, it is predicted that if the intensity of SR light can be increased depending upon an object, it will be significant.

Heretofore, in an SR light source having a charged particle orbit including straight section, a trial of generating SR light has been also practiced which has the nature of monochromatic light by providing an undulator which are formed by arraying a plurality of magnets having alternate polarities, at a straight charged particles. However, due to the fact that in order to obtain monochromatic light having a large intensity by this proposal a long straight portion is necessitated, there is a shortcoming that the SR light source itself becomes extremely large-sized.

A problem of the present invention is to provide an SR light source having a high utilization efficiency for SR light.

Another problem of the present invention is to provide an SR light source which can generate SR light also having the nature of monochromatic light or laser light.

Still another problem of the present invention is to provide an SR light source which can enhance an intensity of SR light.

DISCLOSURE OF THE INVENTION

The present invention discloses an SR light source which not only can store charged particles in an orbit but also can store SR light (hereinafter called "photon storage ring"), and intends to resolve all the above-mentioned problems. In more particular, according to the present invention, there is provided a photon storage ring, in which by arranging a reflection mirror or mirrors at the position where SR light generated in the tangential direction of a charged particle orbit can be reflected, the SR light an d the reflected light can be stored within the reflection mirror.

PREFERRED EMBODIMENT 1

Figure 1:
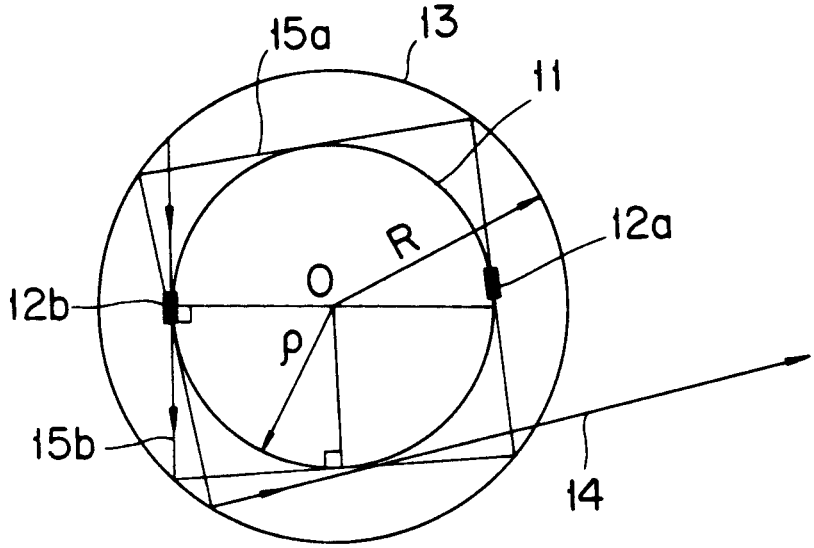
FIG. 1 is a general construction view showing a photon storage ring according to Preferred Embodiment 1 of the present invention.

With reference to FIG. 1, description will be made on an SR light source, that is, a photon storage ring according to a first preferred embodiment of the present invention. The photon storage ring shown in FIG. 1 is provided with a vacuum container of circular shape (not shown) and a magnetic field generating device composed of bending magnets such as superconductive electromagnets (not shown) similarly to the SR light source known as the so-called compact SR light source, and charged particles such as electrons are incident from an injection accelerator such as a microtron through an inflector or the like into the vacuum container. Within the vacuum envelope, since a magnetic field reaching to several teslas is generated by the above-mentioned magnetic field generating device, the incident charged particles would move at a speed close to the light velocity as moving on a circular orbit having a curvature determined by the strength of the applied magnetic field. As is well known, the charged particles would move as locally crowded on the circular orbit into bunches 12, and the number and length of the bunches are determined by the operating condition and the design condition of the SR light source. For convenience of the following explanation, the radius of the circular orbit is represented by $\rho$, and it is assumed that the aforementioned conditions are set so that the number of bunches may become 2. In this connection, it is postulated that the respective bunches are called first and second bunches and they are represented by 12*a* and 12*b*. Under this condition, from the respective bunches moving on the circular orbit at a speed close to the light velocity is generated SR light in the tangential direction of the circular orbit.

In the illustrated photon storage ring, a reflection mirror 13 is disposed so as to wholly surround the outer circumference of the charged particle orbit, and at a part of the reflection mirror 13 is provided a light take-out port 14 for externally taking out SR light. While the reflection mirror 13 is disposed so as to wholly surround a charged particle orbit 11 in this figure, the reflection mirror 13 could be disposed so as to partly surround the charged particle orbit 11. In addition, the light take-out port 14 is not limited to one, but a plurality of light take-out ports could be provided, and the structure of the light take-out port 14 could be either of constantly opened type or of the type opened or closed depending upon necessity. Furthermore, the light take-out port 14 could be constructed of a half-mirror.

In the illustrated embodiment, while explanation will be made on the basis of the assumption that the reflection mirror 13 has a predetermined curvature and the center of curvature thereof substantially coincides with the center of curvature of the charged particle orbit 11 for simplicity of the explanation, the centers of curvature of the reflection mirror 13 and the charged particle orbit 11 need not always coincide with each other. In either case, the SR light is stored within the reflection mirror 13, jointly with the charged particles.

SR light beams generated from the respective bunches 12*a* and 12*b* at different time would be reflected respectively by the reflection mirrors 13, and form optical paths indicated by 15*a* and 15*b* in FIG. 1.

Here, in the case where the center of curvature of the reflection mirror 13 substantially coincides with the center of curvature of the charged particle orbit, the optical paths 15*a* and 15*b* of the respective reflected SR light beams would proceed so as to be tangential to the charged particle orbit after every reflection. Consequently, all the SR light beams generated at the positions where the optical paths 15*a* and 15*b* and the charged particle orbit are tangential to each other, proceed along the same optical paths, which finally reaches the take-out port 14. In other words, it is possible to cause SR light beams generated at a plurality of bunches and then reflected to proceed along a particular optical path in a pulse train. Accordingly, SR light beams generated at the portions where the optical paths 15*a* and 15*b* reaching the light take-out port 14 and the charged particle orbit 11 are tangential to each other are all led to the light take-out port 14, and the SR light taken out from the light take-out port 14 would be observed always in the substantially same direction. This fact in itself means that the SR light observed at the light take-out port 14 is enhanced in intensity by a factor proportional to or equal to the number of reflections.

In the case where the charged particle orbit is a perfect circular orbit, as shown in FIG. 1, since the optical path 15*a* of the reflected SR light beam would be always tangential to the charged particle orbit 11 and the SR light beams generated at the tangential position are all led to the light take-out port 14, a utilization efficiency of SR light can be remarkably improved.

On the other hand, in the case where the charged particle orbit is not a circular orbit, for instance, in the case where the charged particle orbit includes a straight portion, also a utilization efficiency of SR light can be improved by causing the SR light beam to be reflected by the reflection mirror 13 so as to be tangential to the charged particle orbit and leading SR light generated at a plurality of positions to the light take-out port 14.

Here, in a photon storage ring wherein a charged particle orbit is a circular orbit and also coincides with the center of curvature of a reflection mirror, a light beam of a short pulse having a large intensity can be generated by selecting the radii of curvatures of the charged particle orbit and the reflection mirror.

PREFERRED EMBODIMENT 2

Figure 2:
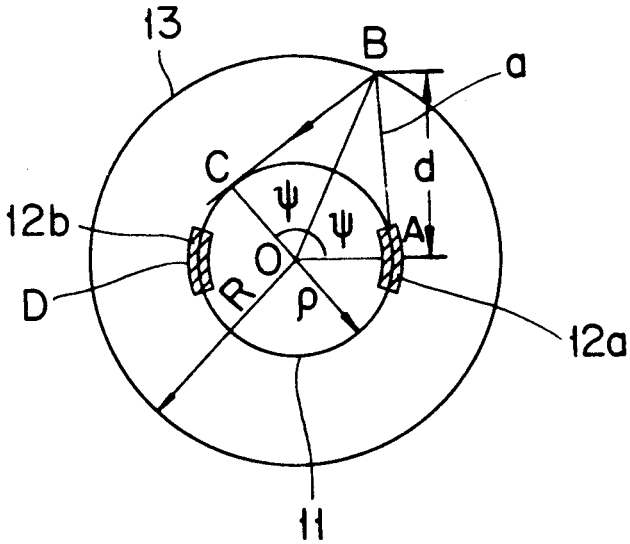
FIG. 2 is a general construction view of a photon storage ring for explaining Preferred Embodiment 2 of the present invention.

With reference to FIG. 2, description will be made on the reflection between the radii of curvatures of the charged particle orbit and the reflection mirror for generating a short-pulsed light beam having a large intensity in the photon storage ring shown in FIG. 1. FIG. 2 shows the case where the bunches consisting of changed particle groups are formed two similarly to FIG. 1, and in FIG. 2 it is assumed that the first and the second bunches 12*a* and 12*b* are performing revolving motion on the charged particle orbit periodically at equal intervals and at an orbital speed $v$. In addition, in the following, description will be made assuming that the radius of curvature of the reflection mirror is R.

In FIG. 2, an SR light beam generated from a first bunch 12*a* at point A on a charged particle orbit 11 passes through an optical path a and is reflected at point B by a reflection mirror 13, and it again intersect with the charged particle orbit 11. Accordingly, at the time point when the SR light beam from the first bunch 12*a* has reached a point C, if either bunch should be present at this point C, both the SR light beam generated from this bunch and the SR light beam from the point A could be observed. Now, representing the center of curvature of the charged particle orbit 11 by 0 and the angle formed between OA and OC by $2\psi$, the time Tb required for a charged particle to pass from A to C is represented by the following equation:

$$Tb = 2\psi\pi/v \tag{1}$$

On the other hand, the time Ta necessitated for an SR light beam to pass from A to C is given by the following equation, representing the light velocity by c:

$$Ta = 2\rho\tan(\psi)/c \tag{2}$$

Of course, since Ta is larger than Tb, it would never occur that an SR light beam generated from the bunch 12*a* at the point A meets again the first bunch 12*a* which was at the point A. However, it is possible to adjust so that the second bunch 12*b*, which was at the symmetric position (a point D) of the first bunch 12*a* with respect to the center point, may come to the point C after the time Ta, or to adjust so that a bunch which was present further n half-periods behind may come to the point C after the time Ta. Speaking in more detail, the condition for the SR light beam from the point A to meet a bunch again at the point C is given by the following equation:

$$Tb + n\pi\rho/v - Ta = 0 \tag{3}$$

Generalizing the equation (3), a condition for second meeting in the case where an SR light beam meets a bunch again after having been reflected q time, can be also calculated, and the condition for second meeting in this case is given by the following equation (4):

$$(q\psi + n\pi)\rho/v - qTa = 0 \tag{4}$$

The radius of curvature R of the reflection mirror 13 is given by the following equation:

$$R=\rho/\cos(\psi) \quad (5)$$

Since the bunches are present in a symmetric manner with respect to the center of curvature of the charged particle orbit 11, the relation between the reflected SR light beams (reflected light) and the bunches fulfils the above equation at any time point. Accordingly, in the case where the above equation is fulfilled, from the light take-out port 14 emanate SR light beams from a number of bunches as integrated. As a result, at the light take-out port 14 is taken out an intense short-pulsed light beam.

In addition, in the case where a photon storage ring is being operated under the condition where k bunches are generated, the equation (4) can be modified into the equation (4'):

$$(q\psi+2n\pi/k)\rho/v-qTa=0 \quad (4')$$

As a practical condition for generating short pulses, when q and n are respectively equal to 1, k is equal to 2 and $\rho$ is 0.5 m, R=about 1.486 m is resulted. A reflection mirror having such a curvature is possible to be realized with a sufficiently good precision by making use of the conventional polishing technique.

Figure 3A:
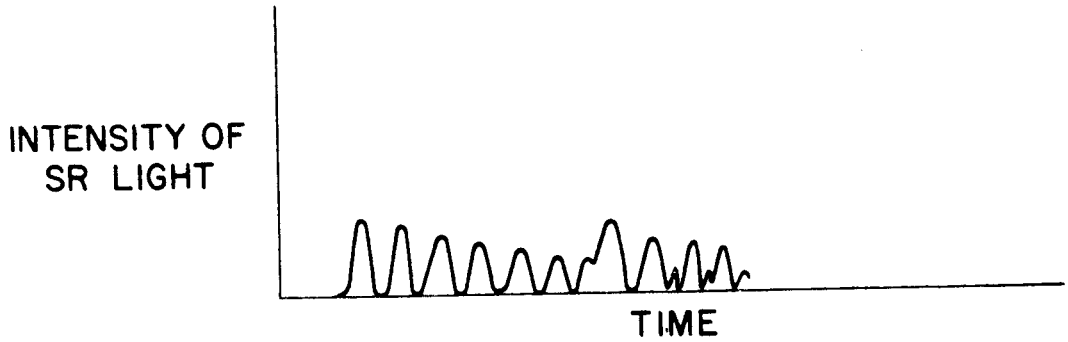
FIG. 3(*a–b*) is a time chart for explaining SR light generated from the photon storage ring shown in FIG. 2.
Figure 3B:
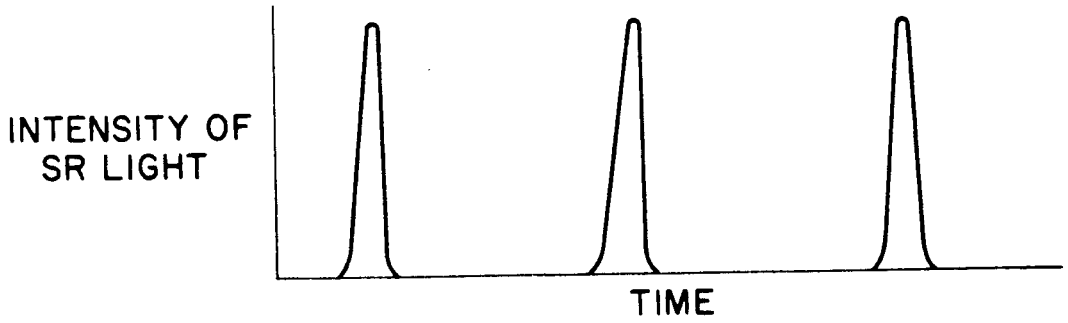

Referring to FIGS. 3(*a*) and 3(*b*), in the event that the radii of curvatures $\rho$ and R of the charged particle orbit 11 and the reflection mirror 13, respectively, do not fulfil the equation (5), at the light take-out port 14 of the photon storage ring, normal SR light is observed continuously in time as shown in FIG. 3(*a*). On the other hand, in the event that the radii of curvatures $\rho$ and R of the charged particle orbit 11 and the reflection mirror 13 have been selected so as to fulfil the equations (4') and (5), short pulses having a high intensity can be observed intermittently as shown in FIG. 3(*b*).

PREFERRED EMBODIMENT 3

Figure 4:
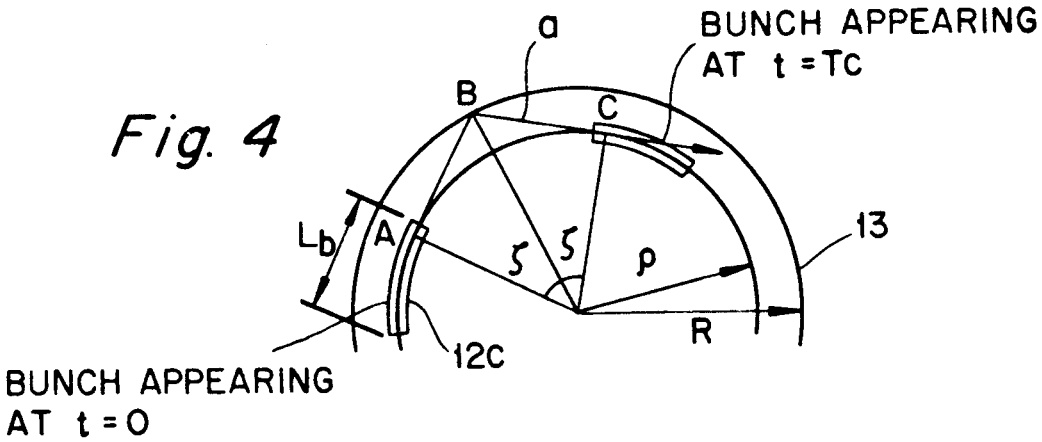
FIG. 4 is a schematic construction view for explaining a photon storage ring according to another preferred embodiment of the present invention.

With reference to FIG. 4, description will be made on a photon storage ring according to Preferred Embodiment 3 of the present invention, which generates short-pulsed SR light (that is, a light beam) having a large intensity similarly to the case shown in FIG. 3(*b*). As shown in FIG. 4, a bunch within a photon storage ring has a certain length, and practically has a length of several centimeters, and this length of the bunch as well as the number of the bunches are different depending upon an operating condition. Taking this fact into consideration, in this Preferred Embodiment 3, an SR light beam generated at the leading end portion of each bunch is, after reflected, incident to the trailing end portion of the same bunch to make the SR light beam meet the bunch again, and thereby short-pulsed SR light having a large intensity is generated.

Now it is assumed that in FIG. 4, an SR light beam generated at a time point t=0 from a point A on a charged particle orbit 11 in the leading end portion of a bunch 12*c* having a length of Lb is reflected at a point B on a reflection mirror 13 and passes through an optical path a, and after a time Tc it reaches a point C on the charged particle orbit 11. On the other hand, it is assumed that the trailing end portion of the bunch 12*c* reaches the point C on the charged particle orbit 11 after lapse of a time Td. In this case, Tc and Td are respectively represented by the following equations (6) and (7).

$$Tc=2\rho\tan(\zeta)/c \quad (6)$$

$$Td=(2\rho\zeta+L)/v \quad (7)$$

It is to be noted that the equation (7) is valid for L equal to or less than the maximum length Lb of the bunches. If Tc and Td are equalized, then the condition of second meeting of the bunch and the SR light can be sought for, and under this condition, the radius of curvature R of the reflection mirror 13 can be calculated. Accordingly, by making use of a reflection mirror 13 having the radius of curvature R calculated on the basis of the equation (6) and the equation (7), short pulses having a large intensity can be generated, and also a utilization efficiency of an SR light can be improved.

Here, when the radius $\rho$ of the charged particle orbit has been chosen to be 0.5 m and Lb has been chosen to be 3 cm, the radius of the reflection mirror 13 becomes about 0.55 m, and this numerical value is a well realizable value. Even if Lb is made shorter than 3 cm, the reflected SR light and the bunch can be made to meet again.

In this preferred embodiment, as compared to the Preferred Embodiments 1 and 2 explained with reference to FIGS. 1 to 3, the radius of curvature of the reflection mirror 13 can be made small. This in itself means that a reflection efficiency can be improved by enlarging the incident angle of the SR light to the reflection mirror 13.

It is to be noted that after SR light has been made to meet again by making use of the leading end portion and the trailing end portion of a bunch as is the case with the Preferred Embodiment 3, further the SR light can be made to intersect with the leading end portion of the bunch coming from the rear as is the case with the Preferred Embodiment 2.

PREFERRED EMBODIMENT 4

Again with reference to FIG. 2, description will be made on a photon storage ring according to Preferred Embodiment 4 of the present invention. This Preferred Embodiment 4 is used for taking out a particular wavelength from a SR light source which is substantially white light. Here, SR light beams emanating from a number of bunches and then reflected, are caused to interfere under a particular condition and thereby only a light beam having a particular wavelength is emphasized. It is to be noted that in the photon storage ring according to this preferred embodiment also, it is assumed that the charged particle orbit 11 and the reflection mirrors 13 are provided with a circular shape and moreover they have an identical center of curvature. Furthermore, it is assumed that in the illustrated photon storage ring, two bunches consisting of first and second bunches 12*a* and 12*b* are moving along the charged particle orbit 11 while always maintaining a positional relationship such as being symmetric with respect to the center of curvature.

As will be apparent even from the above statement, in this Preferred Embodiment 4, interference is caused in the SR light beams due to interactions among the SR light beams. To that end, an optical path difference (in this embodiment, that is equal to a time difference) is provided between the SR light beams, thereby interference is caused between the SR light beams, and thus light beams having a particular wavelength are emphasized. The wavelength of the light beams to be emphasized is determined by the phase difference between the light beams depending upon the optical path difference. In other words, the illustrated photon storage ring can generate interference by selecting the radius of curvature of the reflection mirror 13 and the light wavelength $\lambda$, thereby only a light beam having a particular wavelength is emphasized, and monochromatized light can be taken out.

In FIG. 2, an SR light beam emitted at time $t=0$ from a first bunch 12*a* existing at point A on a charged particle orbit 11 in the tangential direction (optical path a) is reflected at point B on a reflection mirror 13 forming a concentric circle with respect to the charged particle orbit 11, and at point C it again becomes tangential to the charged particle orbit 11. At this time, the time required for the SR light beam to proceed from point A to point C is Ta, which is similar to the equation (1). The time when the second bunch 12*b* that was present at the position retarded by one-half period at $t=0$ arrives at the point C, can be represented by $(Tb+n\pi\rho/v)$ by making use of Tb in the equation (2).

In general, according to the principle of interference of light, in the case where an optical path difference between two light beams when they are observed at an observation point corresponds to a fundamental wavelength $\lambda$ of an interfered light beam, an interfered light beam is obtained at the observation point.

In the case of the above-described photon storage ring, the optical path difference is represented as the difference in timing of observation for the successively emitted SR light beams, and the wavelength of the interfering light beams can be derived from this difference in timing. However, when the wavelength of the interfering light beams is derived, since the phase of the light beam advances by one-half wavelength when the SR light beam is reflected by the reflection mirror 13, this must be taken into consideration. It is to be noted that depending upon a material of the reflection mirror 13, an inherent value other than $\lambda/2$ must be employed (this being also true in the subsequent discussion). More particularly, the wavelength $\lambda$ of the interfering light beams can be calculated by the following equation (8):

$$m\lambda/c=|Ta+\lambda/(2c)-(Tb+n\pi\rho/v)| \quad (8)$$

where m is an integer ($\geqq 1$) and represents an order of a harmonic wave, n is also an integer ($\geqq 1$) and represents an n-th rear bunch.

Further generalizing this relation, the following equation is derived:

$$|(2q\psi+2n\pi/k)\rho/v-q(2\rho tan(\psi)\pm v)/c|=m\lambda/c$$

In the above equation, q and k respectively represent the number of reflections and the number of bunches.

From the equation (8) and the equation (5), a radius of curvature R of the reflection mirror 13 for obtaining a necessary wavelength can be calculated. For instance, when the radius of the charged particle orbit 11 is 0.5 m and charged particles are moving at a speed very close to the light velocity, in order to obtain interfering light beams of 0.2 $\mu$m in wavelength, the radius of curvature could be set at the order or $R=1.485847$ m. In this case, the radius of curvature of the reflecting surface of the reflection mirror 13 must be finished at the precision of the order of the wavelengths. At the present, the machining technique for a spherical surface reflection mirror has been greatly developed, so that a spherical surface mirror whose radius of curvature is several meters can be manufactured at a curved surface precision of several hundreds angströms and at a surface roughness of the order of several angströms. Accordingly, machining of the above-described reflection mirror 13 can be well realized by employing the machining technique for a spherical surface reflection mirror in the prior art.

If the successively generated SR light beams are reflected and made to interfere by making use of the reflection mirror 13 satisfying the aforementioned condition, it is possible to monochromatize the SR light beams and to produce a light beam having a high intensity with respect to a particular wavelength and its higher harmonics. The degree of the generated interference becomes strong as the peaks of the light emanating from the bunches are sufficiently separated from each other.

In the case where a photon storage ring which stores light within a ring is employed, since the speed of charged particles can be maintained well constant, a time difference between SR light beams can be maintained at a high precision, and also since a converging effect for light is acted by the reflection mirror 13 of circular shape, it is easy to sustain a condition for interference. This is an extremely large merit as compared to the case where interfering light beams are generated by making use of an undulator.

PREFERRED EMBODIMENT 5

In a photon storage ring according to Preferred Embodiment 5 of the present invention, paying attention to the fact that the bunch has a finite length, a light beam emanating from the leading end portion of the bunch is reflected and is made to interfere with a light beam emanating from the trailing end portion of the same bunch. In this respect, it is similar to Preferred Embodiment 3. Accordingly, the wavelength for causing interference can be calculated from the following equation (9) by making use of the equation (6) and the equation (7):

$$m\lambda/c=|Tc+\lambda/(2c)-Td \quad (9)$$

It is to be noted that while the possibility of occurrence of interference in such manner is only once, if provision is made such that this interfering light may intersect with a light beam emanating from another bunch under the same phase condition, it is possible to sustain the interfering condition.

In more particular, it is only necessary to seek for the condition that when the interfering light beam becomes tangential to the orbit after it was reflected q times, the leading end of the next or next to the next coming bunch intersects therewith. The condition is given by the following equation (10):

$$|q(2\rho tan(\zeta)\pm v/c-(2n\pi/k+2q\zeta)\pi/v|=m\lambda/c \quad (10)$$

Here, an integer n means an n-th rear bunch, and k represents the number of bunches. Since L is allowed to vary in magnitude to a certain extent within the range satisfying the relation of $L\leqq Lb$, it is possible to find out $\xi$ which satisfies the equation (9) and the equation (10). When $\rho=0.5$ m is selected, for $n=1$ and $k=2$ the above-mentioned conditions are fulfilled at $q=50$. If a reflecting power of the reflection mirror 13 is maintained at about 99.95%, even after 50 times of reflection reflected light of 99.5% is still stored within the photon storage ring, and so, it is sufficiently possible to sustain interference.

While the radius of curvature of the charged particle orbit 11 was assumed to be constant and the radius of curvature of the reflection mirror 13 was calculated in the above-described explanation for the Preferred Embodiments 4 and 5, it is a matter of course that selection of a wavelength can be effected by changing the radius of curvature of the charged particle orbit. Thus, it is also a large merit of the photon storage ring that the radius of curvature of the charged particle orbit can be changed.

Figure 5:
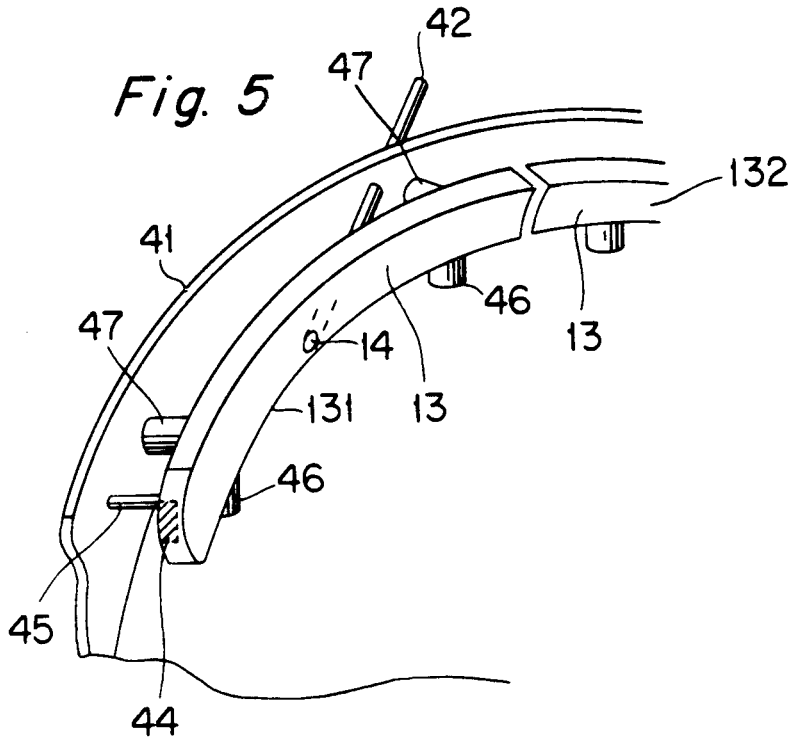
FIG. 5 is a partial perspective view for explaining a detailed construction of a photon storage ring according to the present invention.

Referring now to FIG. 5, one example of a detailed construction of the photon storage ring according to Preferred Embodiment 5 of the present invention is illustrated. This photon storage ring comprises a vacuum container 41 and a reflection mirror 13 disposed inside of the vacuum container 41, and this reflection mirror 13 has the same center of radius as that of a charged particle orbit (not shown in this figure). The reflection mirror 13 includes a substrate made of SiC or the like and a reflection surface formed by coating this substrate with gold or the like. This reflection surface has a predetermined curvature in the horizontal plane as viewed in the figure, and also it has a curvature in the vertical plane, too. The curvature in the vertical plane is provided for the purpose of making reflected SR light converge again on the charged particle orbit, because the SR light is emitted radially also in the vertical plane. More particularly, a radius of curvature equal to $\rho\tan(\psi)$ is given to the reflection mirror 13 in the vertical plane.

To a part of the reflection mirror 13 is mounted a light take-out port 14, and this light take-out port 14 is connected through a hollow pipe to a light take-out port 42 outside of the vacuum container 41.

Furthermore, since the reflection mirror 13 is heated by the reflection of SR light and expands, in some cases the radius of curvature of the reflection mirror 13 would change. In such event that the radius curvature changes, the wavelength of the light generating interference would vary with time.

In order to prevent the change of a radius of curvature caused by thermal expansion of the reflection mirror 13, on the surface of the reflection mirror 13 opposite to the reflecting surface is mounted a groove 44 for water cooling, and this groove 44 is connected to the outside of the container 41 via pipings 45. Still further, in the illustrated photon storage ring, the reflection mirror 13 is severed into a plurality of segments 131, 132, etc., and a vertical direction fine adjustment device 46 and a radial direction fine adjustment device 47 making use of piezoelectric elements or the like are mounted to the respective segments 131, 132 so that the respective segments 131, 132 can be finely adjusted in the vertical direction and in the direction of the radius of curvature by making use of piezoelectric elements.

While the construction shown in FIG. 5 was explained as a detailed construction of the Preferred Embodiments, the photon storage rings according to the other preferred embodiments also have similar constructions.

PRINCIPLE OF LASER OSCILLATION

In the photon storage rings disclosed in the above-described sections of Preferred Embodiments 1, 2 and 3, a utilization efficiency of SR light can be raised by making a reflected SR light beam and a bunch on a charged particle orbit intersect with each other in an arbitrary timing relationship, and in the photon storage rings disclosed in the sections of Preferred Embodiments 4 and 5, interfering light beams are generated by making phases match among light beams, and thereby a monochromatized SR light beam can be obtained. However, by merely making an SR light beam and a charged particle orbit intersect with each other, stimulated emission of light from charged particles cannot be achieved, and accordingly, laser oscillation cannot be generated.

Figure 6:
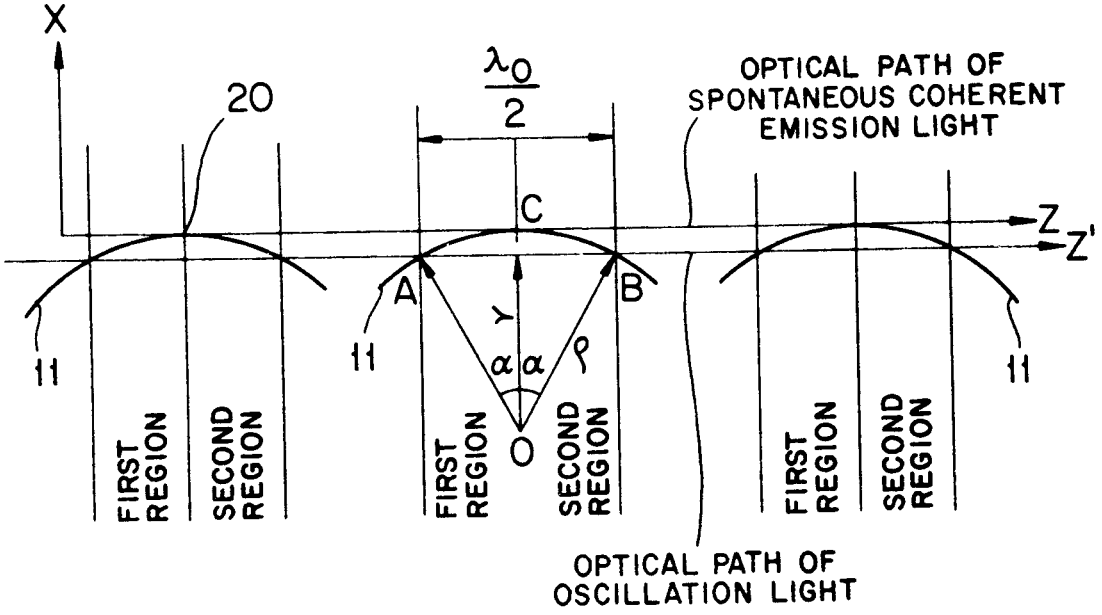
FIG. 6 is a diagram for explaining a principle of amplification of SR light by making use of yet another preferred embodiment of the present invention.

A principle of a photon storage ring according to the present invention which can achieve laser oscillation, will be explained with reference to FIG. 6. In this case, since light beam not relying upon stimulated emission and light beam relying upon stimulated emission are generated from electron bunches, the former is called spontaneous coherent emission, and the latter is called oscillation light or stimulated emission. In addition, in the event that both the spontaneous emission light and the stimulated emission light are included, in the following it will be called simply light. In FIG. 6, an optical path of a certain SR light beam repeating reflections, that is, a spontaneous emission light beam is stretched to be denoted as a Z-axis. In addition, as will be apparent from FIG. 6, a charged particle orbit 11 of circular shape is divided into a first region and a second region, and at the boundary between the adjacent regions, a crest portion (that is, a top) 20 of the charged particle 11 is tangential to the Z-axis. It is to be noted that at the middle point between a top and another top is present a reflection mirror.

As shown in FIG. 6, spontaneous emission light emanating from a top of the charged particle orbit 11 would successively meet the charged particle orbit again at another top. Here, the traveling direction of the charged particle group, that is, the bunch at the top of the charged particle orbit 11, is the Z-axis direction. Accordingly, at the top the traveling direction of the bunch coincide with the traveling direction of the spontaneous emission light indicated by the Z-axis.

In general, when a traveling direction of light and a traveling direction of a charged particle group are the same, since an electric field vector of the light is perpendicular to the direction of traveling of the charged particle group, the charged particles would not be subjected to an interaction from the light, and accordingly, the charged particles would not be either accelerated nor decelerated by the light. Thus, if the charged particles are not subjected to deceleration, stimulated emission of light from the charged particles would not arise. On the other hand, when the charged particles and the light intersect with each other at an angle, since an electric field of the light has a component in the traveling direction of the charged particles, the charged particles would be decelerated or accelerated by the electric field of the light. Occurrence of stimulated emission of light from charged particles is nothing but the case when the charged particles are subjected to deceleration, hence stimulated emission of light would occur repeatedly, and it is seen that in order to generate laser oscillation it is only necessary to make the light intersect with the charged particle orbit 11 at an angle so as to decelerate the charged particles.

Accordingly, in the case of generating laser emission, it is only necessary to make a light beam pass through an optical path inside of the charged particle orbit 11 in FIG. 6, for instance an optical path Z' and thereby to cause the light beam and the charged particles to interact. In other words, it means that under the condition where laser oscillation is sustained, an oscillation light beam, that is, a stimulated emission light beam passes through an optical path inside of the charged particle orbit.

Here it is assumed that, in the first region in FIG. 6, the light beam and the charged particles intersect with each other at point A, and at this point A the charged particles are decelerated by the light beam. Such phase relationship is here called deceleration phase. Assuming that the light beam and the charged particles have entered the second region in the same phase, in the second region the phase relationship would change to acceleration phase because the direction of the normal component (i.e. the X-axis component) of the traveling direction of the charged particles with respect to the Z-axis is reversed. If so, since stimulated emission cannot be generated, if provision is made such that during the period when the region changes, more strictly speaking, during the interval from the point A where the charged particles and the light beam intersected with each other in the first region to the point B where the charged particles and the light beam intersect with each other in the second region, the phase relation between the light beam and the charged particles may shift by a half wavelength, then the deceleration phase continues and stimulated emission becomes possible.

However, light beams having wavelengths which fulfil such phase relationship that during the period when it proceeds from the first region to the second region, phase relationship between the light beam and the charged particles may shift by a half wavelength, are present many. In other words, the Z' orbit can be drawn arbitrarily, and in that means, a wavelength of the oscillation light cannot be determined. Saying reversely, under an oscillating condition, the light beam is considered to proceed along an Z' orbit corresponding to its wavelength. On the other hand, when laser oscillation is occurring, the revolving charged particle bunches must have modulation of a charged particle density corresponding to the wavelength of the oscillating light formed therein. On the contrary, modulation of a charged particle density is formed by the built-up laser light, and if this does not sustain, the laser oscillation would not occur. However, the modulation of a charged particle density is formed for a particular wavelength, and if light having various wavelengths should interact with charged particle bunches, a particular modulation of the charged particle density would not be formed. Furthermore, unless the bunches and the oscillation light beam is always held in a fixed phase relationship, the modulation in density of the charged particles cannot be maintained.

In a photon storage ring based on this principle, by maintaining the light beams and the charged particles always in deceleration phase and also by selecting a wavelength, modulation of a charged particle density corresponding to that wavelength is formed within a bunch, and thereby laser oscillation is effected.

As described above, in order to effect laser oscillation, it is necessary to select light having a particular wavelength and to generate modulation in density of charged particles within a bunch, and here, investigating what condition is fulfilled in the case where laser oscillation is occurring, it is seen that the following equation (11) is valid:

$$(\lambda_0/2)(C-V_Z)/V_Z)=\lambda/2 \qquad (11)$$

where $\lambda_0/2$ represents the length in the Z-axis direction between the points A and B where the light beam intersects with the charged particle orbit in FIG. 6, $V_Z$ represents an average speed in the Z-axis direction of the charged particles, and $\lambda$ represents an oscillating wavelength. However, since the charged particles are subjected to repulsion when stimulated emission of light from the charged particles is present, it is necessary to take into consideration the fact that the oscillation wavelength $\lambda$ in the equation (11) would be slightly elongated. Furthermore, it must be also taken into consideration that when light passes through a bunch a diffraction index of the light within the bunch would somewhat differ.

The equation (11) is an equation known in connection to a free electron laser making use of an undulator, but in the case where a bending magnet is used as is the case with the photon storage ring according to the present invention, $V_Z$ can be rewritten in the following manner:

$$\begin{aligned} V_Z &= \lambda_0 v/(4\alpha\rho) \\ &= v\sin(\alpha)/\alpha \end{aligned} \qquad (11')$$

In the equation (11'), $\lambda$ represent an angle formed between a segment OA connecting the center of radius O of the charged particle orbit 11 with point A in FIG. 6 and a segment OC connecting the center of radius O and the top 20 (point C) of the charged particle orbit. In this connection, $\lambda$ has a value in the order of m rad, and for instance, when the radius is $\rho=0.5$ m, in order to obtain laser light having a wavelength of about $\lambda=0.333$ $\mu$m, for $\lambda_0$ a value of about 20 mm could be preset.

Now, when it is oscillating, the light must have a particular wavelength, but since the $\lambda_0$ in the equation (11) can take various value by changing the Z' orbit, from the equation (11) the oscillation wavelength cannot be determined uniquely. This is a big difference between the free electron laser making use of an undulator in which an oscillation wavelength is uniquely determined by the period of a magnetic field whose polarity is changed alternately, and the photon storage ring according to the present invention.

As described above, in order to generate laser oscillation in the photon storage ring according to the present invention, means for selecting an oscillation wavelength is necessary.

PREFERRED EMBODIMENT 6

Figure 7:
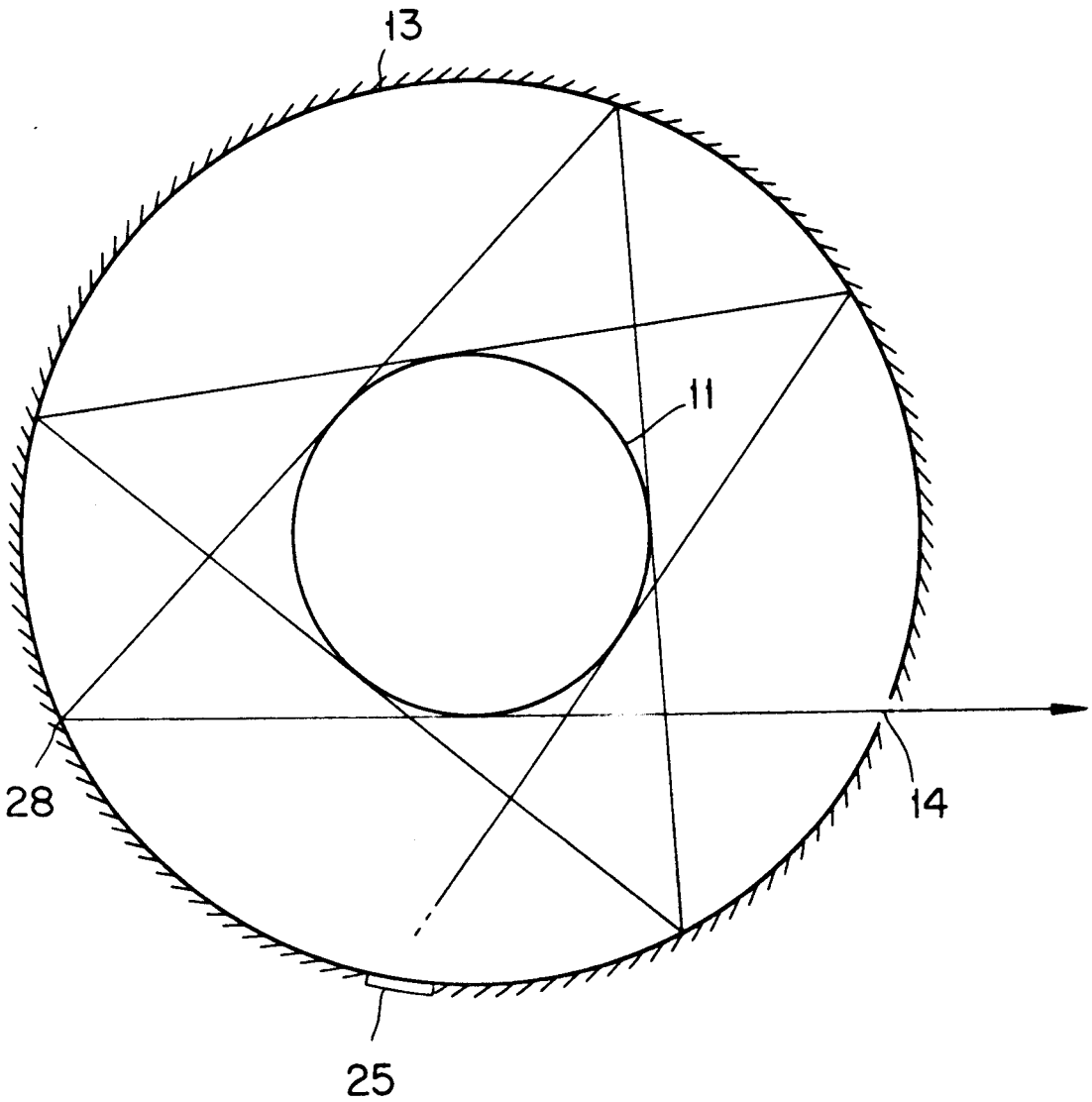
FIG. 7 is a schematic view showing a general construction of a photon storage ring according to another preferred embodiment of the present invention.

Referring now to FIG. 7, a photon storage ring according to Preferred Embodiment 6 of this invention is similar to the other preferred embodiments in that it comprises a reflection mirror 13 disposed so as to surround a charged particle orbit 11 of circular shape and a light take-out port 14. However, this Preferred Embodiment 5 is different from the other preferred embodiments in that a diffraction grating 25 is provided on a part or whole of the reflection mirror 13, and by means of the diffraction grating 25 an oscillation frequency is selected, by employing the light having the wavelength selected by the diffraction grating 25 as a starter, laser oscillation is effected on the basis of the above-described principle. In the case where the diffraction grating is disposed on a part of the wavelength, it is preferably disposed at a position as reflection mirror 13, in view of the fact that the diffraction grating 25 selects an oscillation far as possible from the light take-out port 14. Accordingly, it is necessary that the diffraction grating 25 is disposed at a position other than the position 28 directly opposed to the light take-out port 14.

If the oscillation wavelength $\lambda$ is determined by the diffraction grating 25, $\lambda_0$ is determined by the equation (11), and thereby the Z' orbit is determined. In other words, the oscillation light beam revolves so as to be tangential to a circle having a smaller radius than the charged particle orbit 11. Accordingly, the condition for making the oscillation light beam meet again with the charged particles is naturally different from the equation (3) an the equation (8).

Figure 8:
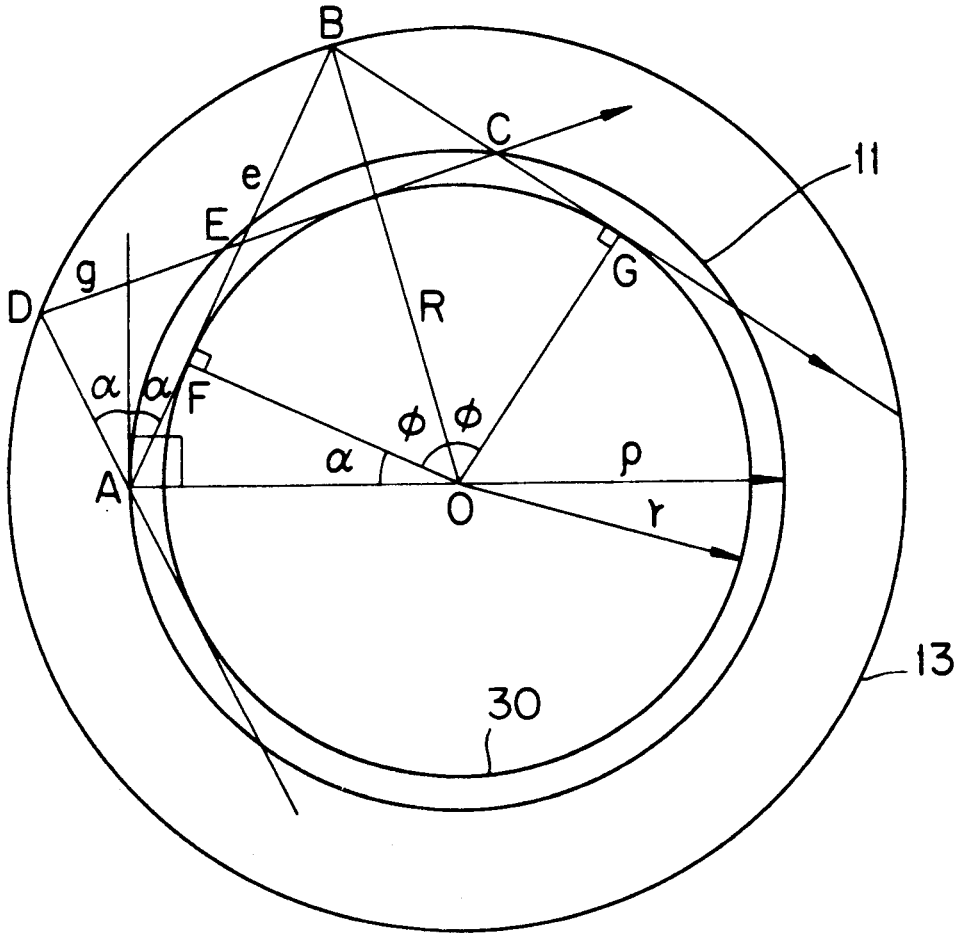
FIG. 8 is a schematic view for explaining an operation of the photon storage ring in FIG. 7.

With reference to FIG. 8, assuming that oscillation light is being generated, a condition for second meeting between the oscillation light beam and the charged particles will be sought. In FIG. 8 are illustrated a charged particle orbit 11 of circular shape having a radius of curvature $\rho$ and a reflection mirror 13 having a radius R and disposed so as to surround this charged particle orbit 11. Now it is assumed that at a certain point A on the charged particle orbit 11 having a center of radius O, oscillation light has been generated along an optical path e. In this case, the optical path e of the oscillation light intersects with the charged particle orbit 11 at point E, and it is reflected at point B on the reflection mirror 13. The oscillation light reflected at the point B further intersects with the charged particle orbit 11 at point C. Thereafter, while the oscillation light is similarly repeating reflection and intersection, it is stored within the ring. In any event, the optical path e of the oscillation light is tangential to a concentric circle 30 having a shorter radius r than the radius of curvature $\rho$ of the charged particle orbit 11. The radius r has a value determined when the oscillation wavelength is determined, and by making use of $\lambda$ in the equation (11'), it is given by following equation:

$$r=\rho\cos(\lambda) \tag{12}$$

This radius r is 0.499975 m when $\rho=0.5$ m and $\lambda=0.333$ $\mu$m are determined.

Now, the points where the oscillation light beam is tangential to the circle 30 and represented by F and G, and the angle formed between the segments OF and OG is represented by $2\phi$. It is to be noted that since the angle formed between the segments OA and OF and the angle formed between the segments OC and OG are respectively equal to $\lambda$, the angle formed between the tangential direction at the point A and the segment AB is also equal to $\lambda$. The time Te necessitated for the light emitted at the point A to be reflected at the point B and arrive at the point C, is represented by the following equation:

$$Te=2r\tan(\phi)/c \tag{13}$$

Next, the time Tv necessitated for a charged particle to move from point A to point C is given by the following equation:

$$Tv=(2\phi+n\pi)\rho/v \tag{14}$$

It is to be noted that in this case also it is assumed that the photon storage ring is operating with 2 bunches.

On the other hand, as will be apparent even from the above-described principle, it is necessary that the phase relationship between the oscillation light and the charged particles shifts by a half wavelength at the point E, and at the point C it shifts further by a half wavelength and returns to the original phase relationship. Accordingly, the condition for the oscillation to sustain is represented by the following equation:

$$m\lambda/c=|Te\pm\lambda/(2c)-Tv|. \tag{15}$$

In addition, the radius of curvature R of the reflection mirror 13 when the oscillation occurs, is given by the following equation:

$$R=r/\cos(\phi) \tag{16}$$

That is, in the equation (15), it is taken into consideration that the phase of the light is advanced by a half wavelength by the reflection mirror 13. As a matter of course, it is also possible to modify the equation (15) such that like the case of the Preferred Embodiment 5, the light may intersect with the charged particles after it was reflected a number of times.

In FIG. 8, the light emitted at the point A with an angle $(-\alpha)$ with respect to the tangential direction, traces an optical path g that is tangential to a circle 30, after it was reflected at a point D. Consequently, the optical path g intersects with the charged particle orbit 11 at the point C thereon similarly to the optical path e. Furthermore, the optical path g passing through ADC is equal in distance to the optical path e passing through ABC, and accordingly, the light passing through the optical path g intersects at the point C under an in-phase condition. This means that the light passing through the optical path g also becomes oscillation light.

In addition, it is to be noted that even if any point on the charged particle orbit 11 were to be chosen as the point A in FIG. 8, the above-described discussion is valid. Therefore, it is resulted that within the photon storage ring are filled oscillation light beams.

PREFERRED EMBODIMENT 7

Figure 9:
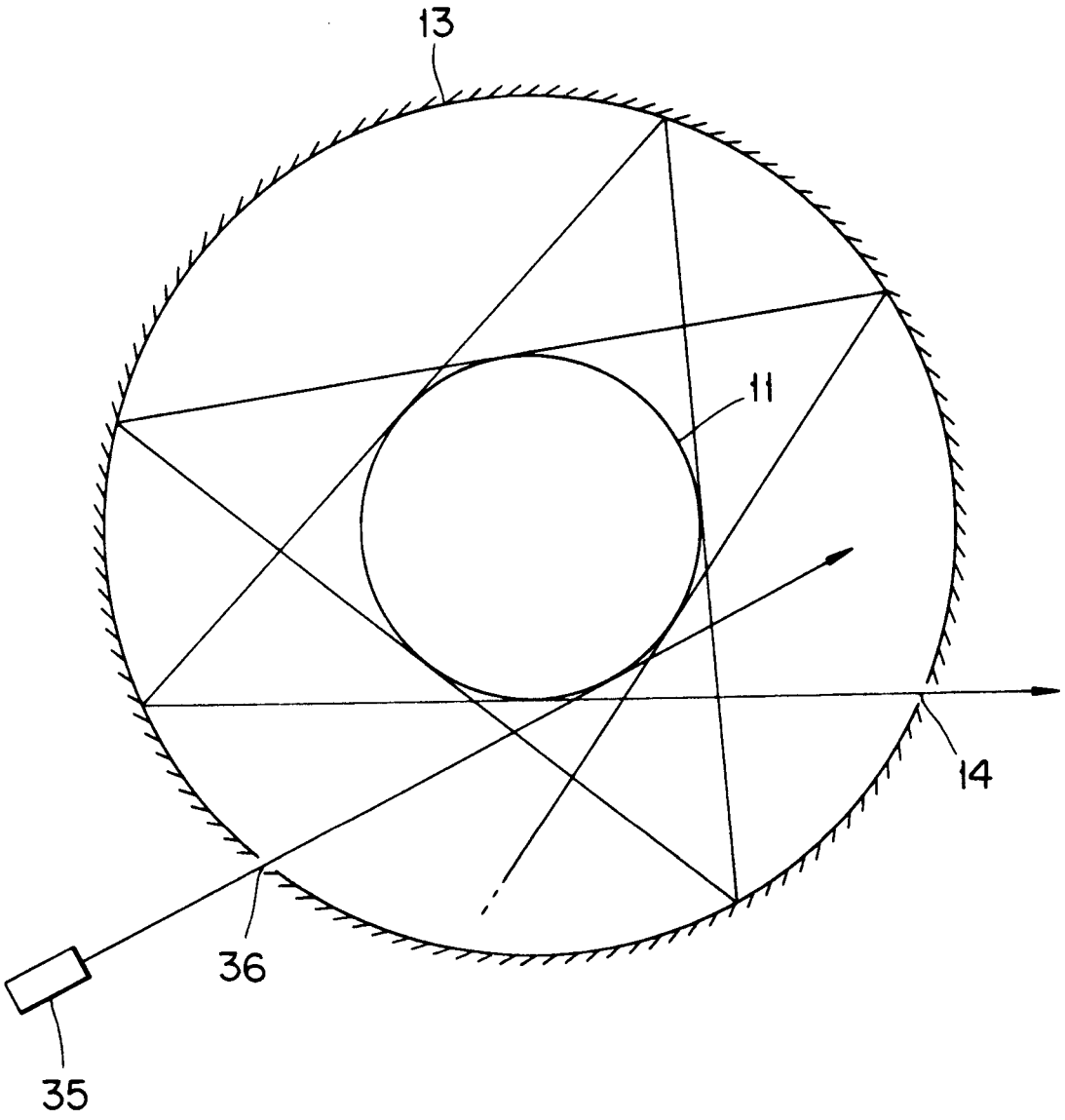
FIG. 9 is a schematic view for explaining a photon storage ring according to still another preferred embodiment of the present invention.

With reference to FIG. 9, in the photon storage ring according to this preferred embodiment of the invention, laser oscillation is effected by making use of laser light in order to select an oscillation wavelength. To this end, in the Preferred Embodiment 7, a laser light generator apparatus 35 for generating laser light having the same wavelength as that of the light to be oscillated is provided on the outside of the reflection mirror 13, and laser light emitted from this laser light generator apparatus 35 is led through an injection port 36 into the reflection mirror 13.

At this moment, the laser light is injected nearly in the tangential direction of the charged particle orbit 11, more strictly speaking to the inside of the charged particle orbit 11 so as to fulfil the relation explained above with reference to FIG. 6. In this case, with respect to the wavelength of the laser light, the reflection mirror 13 has the radius of curvature determined by the equation (15) and the equation (16) above.

In addition, the injection port 36 for injecting laser light is determined depending upon how many times the light is to be reflected before the oscillation light is taken out from the light take-out port, and light having what degree of intensity is to be taken out.

In the photon storage ring having the illustrated construction, laser oscillation can be generated within the photon storage ring by making use of the external laser light as a starter of the oscillation. It is to be noted that the laser light generator apparatus could be disposed in multiple on the outside of the reflection mirror 13.

If the wavelength of the SR light being generated within the photon storage ring is specified or selected by providing a diffraction grating at least on a part of the reflection mirror 13 or by introducing laser light externally into the charged particle orbit 11 as disclosed in the Preferred Embodiments 6 and 7, a modulation of density corresponding to the specified or selected wavelength is formed within the charged particle bunch. In addition, since provision is made such that each time the charged particle bunch and the light intersect with each other the phase of the light may shift by a half wavelength, deceleration phase is sustained, hence amplification of light is generated, and as a result, laser oscillation would occur. In addition, since such a condition is fulfilled at any point on the charged particle orbit, if the reflection mirror and the diffraction grating are disposed over the entire circumference of the charged particle orbit, the SR light can be entirely transformed into coherent laser light, and this transformed laser light can be continuously taken out through the light take-out port 14.

INDUSTRIAL AVAILABILITY

The present invention is not only useful as a light source at the time of producing super LSI's or the like, but it is available as an apparatus necessitating laser light, for instance, as a laser machining apparatus, a laser nuclear fusion apparatus or the like.

What is claimed is:

1. A synchrotron radiation light source for use in an apparatus for generating synchrotron radiation light by making charged particles move along an orbit of a predetermined curvature at a speed close to a light velocity within a hollow space, said synchrotron radiation light being generated in a tangential direction of said orbit, said synchrotron light source comprising:

reflection means, at least partly surrounding said orbit in said hollow space, for reflecting said synchrotron radiation light within said hollow space; and output means for guiding said synchrotron radiation light outside of said hollow space after being reflected.

2. A synchrotron radiation light source as claimed in claim 1, wherein said reflection means comprises:

a circular reflection mirror, having a radius of curvature greater than a predetermined radius of curvature of said orbit, for reflecting said synchrotron radiation light in a tangential direction of the orbit.

3. A synchrotron radiation light source as claimed in claim 1, said orbit being defined by an orbit center and a circular orbit having an orbit radius with respect to said orbit center, wherein said reflection means comprises:

a circular reflection mirror means, having a predetermined center and a predetermined radius greater than said orbit radius, for reflecting said synchrotron radiation;

said orbit center and said predetermined center being substantially coincident; and said orbit and said predetermined radii being selected so that said charged particles, said synchrotron radiation light, and said reflected synchrotron radiation light are mutually synchronous.

4. A synchrotron radiation light source as claimed in claim 3, wherein said orbit and said predetermined radii are selected to provide an optical path difference between said synchrotron radiation light and said reflected synchrotron radiation light and to emphasize only a wavelength determined by said optical path difference.

5. A synchrotron radiation light source as claimed in claim 4, wherein said changed particles revolve along said circular orbit in the form of a plurality of bunches each of which consists of a group of the charged particles and which form a forward bunch and a backward bunch in a revolving direction of said bunches;

said orbit and said predetermined radii being selected so that the reflected synchrotron radiation light which results from the synchrotron radiation light generated by the forward bunch interferes with a selected one of the synchrotron radiation light from the backward bunch and the reflected synchrotron radiation light resulting from the backward bunch.

6. A synchrotron radiation light source as claimed in claim 5, wherein given that the orbit center is represented by O, said synchrotron radiation light is generated at a point A on the circular orbit from said forward bunch and reflected by said circular reflection mirror at a point B and sent towards said circular orbit as the reflected synchrotron radiation light and reaches said circular orbit at a point C, said orbit and said predetermined radii are substantially given by:

$$|(2q\psi+2n\pi/k)\rho/v-q(2\rho tan(\psi)\pm v/c|=m\lambda/c \quad \text{(a)}$$

$$R=\rho/cos(\psi) \quad \text{(b)}$$

where $\rho$ is the orbit radius, n is an integer, K is the number of bunches, q is a positive integer representing the number of times of reflection, $v$ is an orbital speed of charged particles, c is the light velocity, $\lambda$ is a fundamental wavelength of interfering light, m is an integer representing an order of higher harmonics, $\psi$ is an angle formed between segments OA and OB, and $v$ is a correction term added by taking into consideration the fact that each phase of the reflected light is varied by said circular reflection mirror.

7. A synchrotron radiation light source as claimed in claim 4, wherein said charged particles revolve along said circular orbit in the form of a plurality of bunches each of which consists of a group of the charged particles and each of which has a leading end portion and a trailing end portion; and said orbit and said predetermined radii being selected so as to cause interference to occur between the reflected synchrotron radiation light resulting from the synchrotron radiation light emanating from the leading end portion of a selected one of the bunches and the reflected synchrotron radiation light resulting from the synchrotron radiation light emanating from the trailing end portion of said selected one of the bunches.

8. A synchrotron radiation light source as claimed in claim 7, wherein given that the orbit center is represented by O, said synchrotron radiation light is generated at a point A on the circular orbit from said leading end portion and reflected by said circular reflection mirror at a point B towards said circular orbit as the reflected synchrotron radiation light and reaches on said circular orbit at point C when said trailing end portion arrives at C, said orbit and said predetermined radii are substantially given by:

$$|2\rho tan(\zeta)\pm\nu)/c-(2\rho\upsilon+L)/\nu|=m\lambda/c \quad (c)$$

$$|q(2\rho tan(\zeta)+\nu)/c-(2n\pi/k+2q\zeta)\rho/\nu|=m\lambda/c \quad (d)$$

$$R=\rho/cos(\zeta) \quad (e),$$

where $\rho$ is a radius of the circular orbit, n is an integer, k is the number of bunches, q is a positive integer representing the number of times of reflection, $\upsilon$ is an orbital speed of charged particles, c is the light velocity, $\lambda$ is a fundamental wavelength of interfering light, m is an integer representing an order of higher harmonics, $\zeta$ is an angle formed between segments OA and OB, L is a positive number that is variable up to the maximum length Lb of bunches, and $\nu$ is a correction term added by taking into consideration the fact that each phase of the reflected light is varied by the circular reflection mirror.

9. A synchrotron radiation light source as claimed in claim 3, said synchrotron radiation light and said reflection light being stored as stored light within said hollow space by said reflection means, wherein said orbit and said predetermined radii are selected so that the stored light interacts with said charged particles revolving along said orbit, said synchrotron radiation light source further comprising:

extracting means for extracting light of a specific wavelength from said stored light.

10. A synchrotron radiation light source as claimed in claim 9, wherein said extracting means comprises:

selection means for selecting said specific wavelength from said stored light.

11. A synchrotron radiation light source as claim in claim 10, wherein said selection means comprises a diffraction grating disposed at least on a part of said reflection means.

12. An synchrotron radiation light source as claimed in claim 10, wherein said selection means comprises:

laser generating means located outside of said reflection means for generating a laser beam having a wavelength equal to said specific wavelength; and guiding means for guiding said laser beam within said reflection means along said orbit so as to excite the synchrotron radiation light having said specific wavelength.

13. A synchrotron radiation light source as claimed in claim 9, wherein the synchrotron radiation light is emanated from a point A on said orbit in a direction which has an angle relative to a tangential direction of said orbit inside said orbit and travels along an optical path which is tangential to a circle having a radius smaller than said orbit radius and which is formed so as to touch said circle at a point f, to be thereafter reflected by said reflection means at a point B, and to subsequently circumscribe said circle; the orbit and the predetermined radii which are represented by r and R being given by:

$$|(2q\phi+2n\pi/k)\rho/\nu-q(2rtan(\phi)\pm\nu)c|=m\lambda/c \quad (f)$$

$$r=\rho cos(\alpha) \quad (g)$$

$$R=r/cos\ (\phi) \quad (h),$$

where $\rho$ is a radius of the charged particle orbit, n is a positive integer, k is the number of bunches, q is a positive integer representing the number of times of reflection, $\upsilon$ is an orbital speed of charged particles, c is the light velocity, $\lambda$ is a fundamental wavelength of oscillating light, m is an integer representing an order of higher harmonics, $\phi$ is an angle formed between segments OF and OB, and $\nu$ is a correction term added by taking into consideration the fact that the phase of light is varied by the reflection means, and if the wavelength $\lambda$ of the oscillating light is determined, $\alpha$ being also given by:

$$2\alpha\rho/\nu-2\rho\sin(\alpha)/c=\lambda/(2c) \quad (i),$$

when the wavelength $\lambda$ is determined.

* * * * *